US009633519B2

(12) United States Patent
Zimmerl et al.

(10) Patent No.: US 9,633,519 B2
(45) Date of Patent: Apr. 25, 2017

(54) SHORT TIME INTERVAL BETTING SYSTEM AND METHOD HAVING A CINEMATIC DISPLAY AND A PHYSICAL ARENA

(71) Applicant: Novomatic AG, Gumpoldskirchen (AT)

(72) Inventors: Martin Zimmerl, Baden (AT); Andreas Kleinbichler, Gloggnitz (AT)

(73) Assignee: Novomatic AG, Gumpoldskirchen (AT)

( * ) Notice: Subject to any disclaimer, the term of this patent is extended or adjusted under 35 U.S.C. 154(b) by 0 days.

(21) Appl. No.: 14/624,826

(22) Filed: Feb. 18, 2015

(65) Prior Publication Data

US 2015/0170475 A1 Jun. 18, 2015

Related U.S. Application Data

(63) Continuation of application No. 13/208,937, filed on Aug. 12, 2011, now Pat. No. 8,974,292.

(60) Provisional application No. 61/372,932, filed on Aug. 12, 2010.

(51) Int. Cl.
*G07F 17/32* (2006.01)

(52) U.S. Cl.
CPC ..... *G07F 17/3288* (2013.01); *G07F 17/3211* (2013.01); *G07F 17/3244* (2013.01)

(58) Field of Classification Search
USPC ..... 463/6, 16, 21, 25; 700/93
See application file for complete search history.

(56) References Cited

U.S. PATENT DOCUMENTS 7,740,539 B2 * 6/2010 Simon ..... G06Q 50/34 463/16
2004/0058731 A1 * 3/2004 Rossides ..... G06Q 50/34 463/42

* cited by examiner

*Primary Examiner* — Pierre E Elisca
(74) *Attorney, Agent, or Firm* — Kevin H. Fortin

(57) ABSTRACT

A system for enabling betting during the course of an event such as an automotive or horse race. The system includes a physical arena having a track and devices that move in a pattern around the track, a cinematic display corresponding to the physical arena for displaying events and for displaying odds during the course of a particular event, a computer in operative communication with the physical arena and the cinematic display for generating basic outcome probabilities of event outcomes for the set of events. The computer initially, and during the course of an event, determines a win bet probability for a particular event, transforms the win bet probability based on a transformation function to enable real-time betting during the course of the particular event.

20 Claims, 7 Drawing Sheets

SHORT TIME INTERVAL BETTING SYSTEM AND METHOD HAVING A CINEMATIC DISPLAY AND A PHYSICAL ARENA

CROSS-REFERENCE TO RELATED APPLICATIONS

This application is a continuation of co-pending U.S. patent application Ser. No. 13/208,937 filed Aug. 12, 2011, which claims the benefit of U.S. Provisional Patent Application Ser. No. 61/372,932, filed on Aug. 12, 2010, both of these patent applications are incorporated by reference herein for all purposes.

FIELD OF THE INVENTION

The present invention relates to betting systems, in particular to systems that offer bets on races and other events in real time.

BACKGROUND OF THE INVENTION

Gaming machines are typically found in casinos and amusement arcades and offer entertainment and gaming pleasure to many people. Various gaming machines are popular with the gaming public. Betting slot machines enable bets to be placed on events, for example, sporting performances and racing events. Reel slot machines have several rotating reels with various play icons arranged in the display panel's viewing windows or electronically on display screens.

Gaming machines are typically constructed as a kiosk, which is a floor-mounted appliances, being stationary and having a front side having a user interface. In some cases, there is more than one interface in the upper section of the housing so that they can be observed or tracked from a user station in front of the housing. Gaming machines also include web-enabled personal computers programmed with software to enable on-line betting.

An operator's panel included in the interface typically includes several control buttons are provided below at least one display. The operator's panel may be a touch screen, or other interface element, at about the ventral height of a player standing in front of the device. Control buttons may be manually operated and may serve, among other things, to set reels of a reel slot machine in motion, or to stop them. The device's various functional building blocks, like the game controller, a currency authentication device, and/or a currency collection apparatus, can be accommodated within the housing's interior.

These kinds of gaming and entertainment devices are routinely set up in groups in a casino or in an amusement arcade. In this context, the devices can be arranged in rows next to one another, arranged radially, in a star-shaped manner, or around a column. There are numerous ways to arrange gaming and entertainment devices.

Racing games, such as slot-car or horse racing games for example, are known as games in which a plurality of characters race. Such races have a short time interval. Normally short time interval events last less than several minutes. The short time interval makes watching a race both possible and exciting. Attending live short time interval races is inconvenient for many, so various gaming machines on the market provide video of a current, or recorded event to a user.

U.S. Pat. No. 6,848,991 discloses a betting system where a bet is made on an event character selected from a plurality of event characters. Odds are determined in advance for each character. An award is provided on the basis of the odds that the character has finished in a predetermined finishing order, thus qualified for the award. Users may bet on a stronger character, and thus the odds thereof are lowered for the character at the last minute. The users having bet to win may only receive their wager back, and only take risks with no gain, even in a case where the character takes first place.

US Pat. Publication No. US 2009/0233671 presents a system and method that a) periodically sums up bets made by players and received by a gaming terminal, (b) calculates the latest odds on the basis of the latest sum-up result and (c) display the odds to enable further bets. This enables the odds to periodically change during the course of a racing game. The odds periodically change on the onset of the predetermined time deadline for the bet, the performance of the racing characters and on betting patterns.

One great challenge to gaming machine makers is the challenge to perfect the odd-making during the course of an event. Effectively perfecting the odd-making manages risks associated with having large payouts to numerous users for any particular event. Ideally any hold value amount retained by a system provider would exceed the net payouts of any particular event. This insures long term viability for those providing gaming entertainment to users.

Another challenge is to perform such in real time so that a user can decide instantaneously when to place a bet. A further challenge is to make a system that can be used across multiple jurisdictions having diverse hold value requirements, where the hold value is a portion of a bet that is retained by the system provider.

SUMMARY OF THE INVENTION

It is an object of the present invention to provide a betting system that is designed to offer bets on certain events within a short time interval. One example is bets on slot car races that take place in an interval of less than five minutes. Although slot car races are revealed as one example, there are many other events having a short time interval. Horse races, dog races and sporting event races (i.e. running, skiing, etc) are further examples.

The system can be employed in the context of numerous gaming machine configurations. For example, a kiosk for a single user, a table with multiple seated users, or a cinema theme with a large screen viewable by users in rows of gaming stations can be employed using the system of the present invention. The event can be presented as a video, and may include various physical representations of characters that match pace with the respective characters displayed in the video. The video can be of a live event, a recorded event, or an animated event.

The first aspect of the present invention is a betting system for handling betting events, comprising means for determining natural probability values assigned to the events based on a statistical method. A method of handling betting on events includes providing a set of events having duration of less than three minutes. The system generates basic outcome probabilities of event outcomes for the set of events and determines a win bet probability for a particular event. The system transforms the win bet probability into a commercial probability based on a transformation function to enable betting in real time where the transformation function is selected based, in part, on hold values required by the system provider.

During the course of the particular event, the systems determines a win bet probability and transforms the win bet probability based on the selected transformation function. One benefit of selectively using selected transformation functions is that the system can be deployed across various jurisdictions, or locations, each having custom hold value requirements.

The system delivers the win bet probability to users to enable users to execute bets in real time.

The step of determining a win bet probability is performed upon receipt of a win bet and calculated based on the betting patterns of prior bets received. In one embodiment, the racing event includes racing event characters having a sequence and the step of determining win bet probability is performed based on a change in the sequence of racing event characters.

The step of determining win bet probability is not necessarily periodic. It can be non-periodic, performed based on the race event data including any change in sequence or standing of event characters, and betting patterns of users.

The betting system includes a transformation means for applying a transformation function to the natural probability values to get transformed probability values, and a means for providing the transformed probability values to users of the betting system.

The second aspect of the present invention is a betting system wherein separate or in addition the transformation function is $$\text{P_Trans} = \text{Transformation}(p) = \frac{TG}{1 + TG * \text{Factor} * \left(\frac{1}{P} - \frac{1}{TG}\right)^{Exponent}}$$

P_Trans denotes a transformed probability, P denotes the natural probability, TG denotes a transformation threshold, Factor denotes a transformation multiplier and Exponent denotes a transformation exponent.

A third aspect of the present invention is a betting system wherein separate or in addition a risk analysis means is provided for adopting parameters of the transformation function.

The present invention is directed to effectively perfecting odd-making and manages risks associated with having payouts that far exceed hold values. Ideally any hold value amount retained by a system provider would exceed the amount of payouts of any particular event. This insures long term viability for those providing gaming entertainment to users.

DETAILED DESCRIPTION

Figure 1:
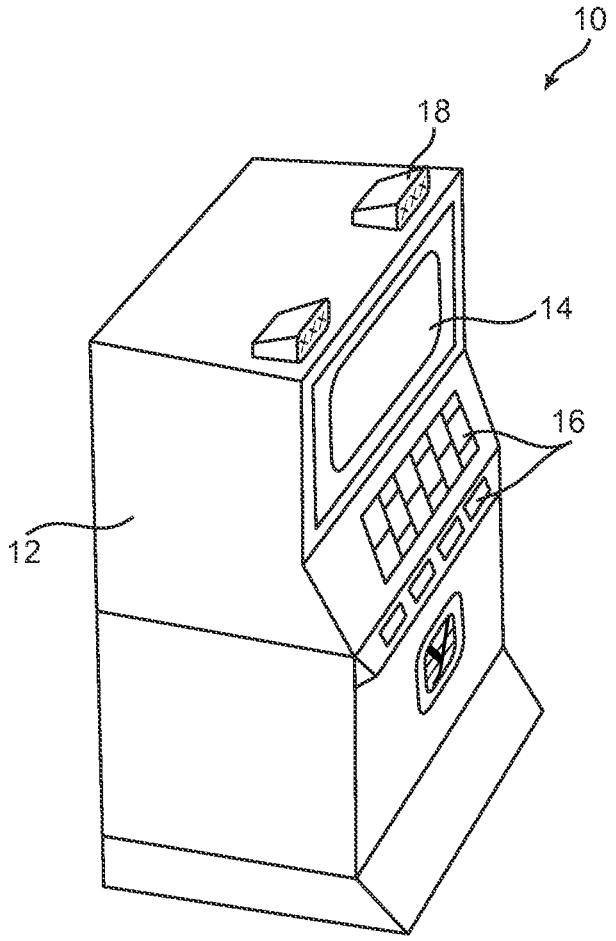
FIG. 1 is a perspective view of a gaming terminal.

FIG. 1 shows a gaming terminal 10 of the present invention. The gaming terminal 10 is a floor-mounted kiosk appliance, which functions as either a stand-alone, or networked device.

The gaming terminal 10 is a box-shaped housing 12 having a display 14 with at least one screen, and a user interface 16. The gaming terminal 10 includes a central processor, random access memory, a bus interconnecting the random access memory with the processor, and a memory storage device for storing data and software. The software includes instructions for the processor. The user interface 16 includes several manually activated control keys, in the form of push-button switches in accordance with one aspect of the invention. Mechanical switches, a touch screen, voice sensors, or other controls can also be provided as part of the user interface 16. The gaming terminal 10 includes audio speakers 18.

The display 14 provides video, text, images, animation and sound to enable a user to operate the gaming terminal 10. The display 14 can provide two dimensional and three dimensional imagery as well as overlying images to maximize user enjoyment.

Figure 2:
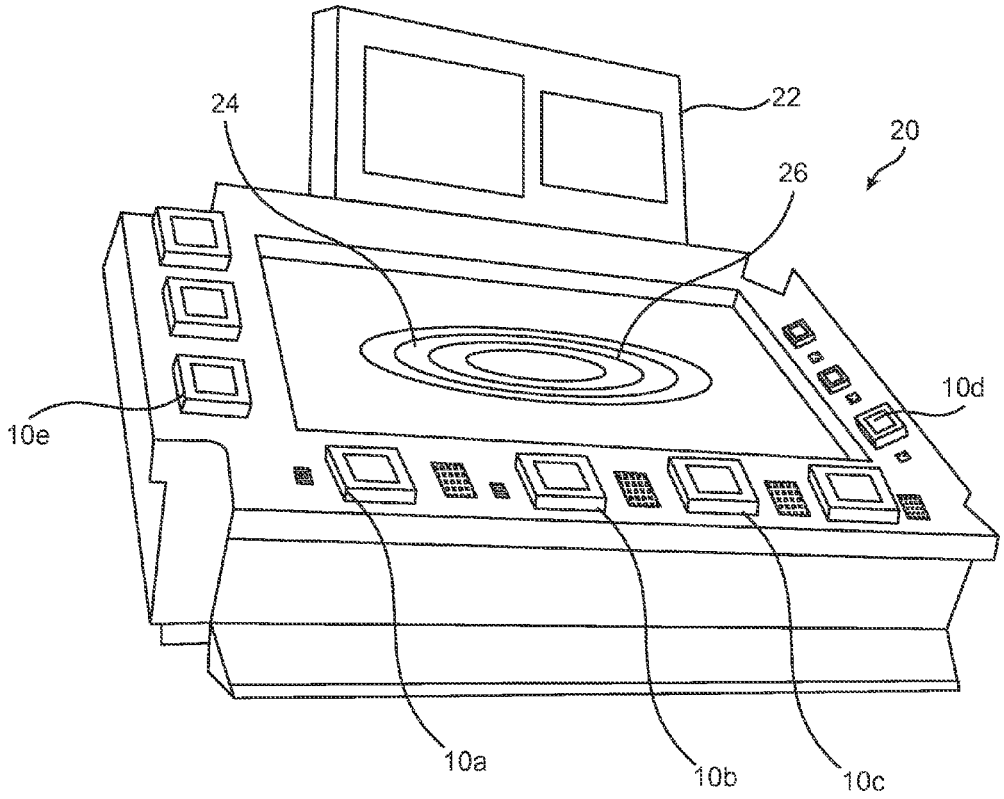
FIG. 2 is a perspective view of a collection of physically connected gaming terminal having a video screen and a physical arena.

FIG. 2 a system 20 of physically connected gaming terminals 10*a*, 10*b*, 10*c*, 10*d* and 10*e*. The system 20 also includes a common video screen 22 and a common physical arena 24.

The video screen 22 displays video programming of an event, as well as gaming information including event details, odds, characters, payouts and other options.

The physical arena 24 includes an oval track 26 with various lanes. The physical arena 24 also provides character devices that move along the track to mimic an event displayed on the video screen 22. This enables players to rapidly assess the sequence and spacing of event characters.

One benefit of having a common physical arena and a common video screen 22 is that numerous players can simultaneously read odds from the video screen 22, see these odds changing as the event progresses, and while seeing the odds change being able to simultaneously view the faces of the other players who's bets may be factors in the changing odds. This adds an exciting human dimension to slot-car racing, horse racing or other event. An array of stand-alone gaming machines, sharing a common cinematic display can also achieve this benefit.

Figure 3:
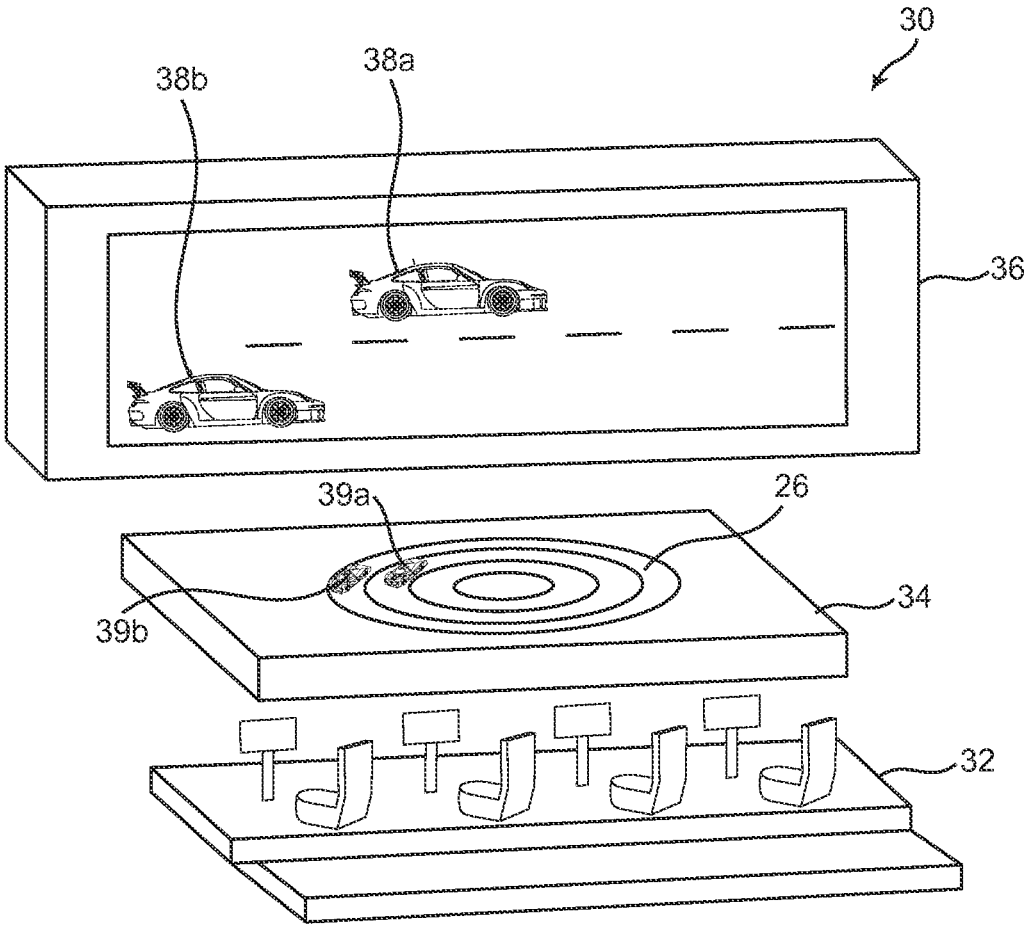
FIG. 3 is a perspective view of a gaming cinema having rows of gaming terminal, a video screen and a physical arena.

FIG. 3 shows a system 30 arranged in a cinema. The system 30 includes a set 32 of gaming terminals, a physical arena 34, and a cinematic display 36, which are interconnected electronically. The cinematic display 36 is sized appropriately to enable multiple viewers to view an event.

The cinematic display 36 shows automobiles 38*a* and 38*b* racing. The physical arena 34 shows automobiles 39*a* and 39*b*, which correspond to and mimic the automobiles 38*a* and 38*b*, respectively. Preferably, the automobiles bear numerical indicia. The sequence of and relative distance between the automobiles corresponds between the cinematic display 36 and the physical arena 34.

The automobiles 39*a* and 39*b* displayed in the physical arena 34 are preferably slot-cars, which move in a predefined pattern along the track 26 and are held on the track 26 by slots. Although automobiles are shown, any physical representation of a slot-enabled device can be used, for example, horse-models can be used in the physical arena 34 to mimic a horse race shown on the cinematic display 36. A virtual slot track displayed electronically is contemplated to be within the scope of the invention.

Figure 4:
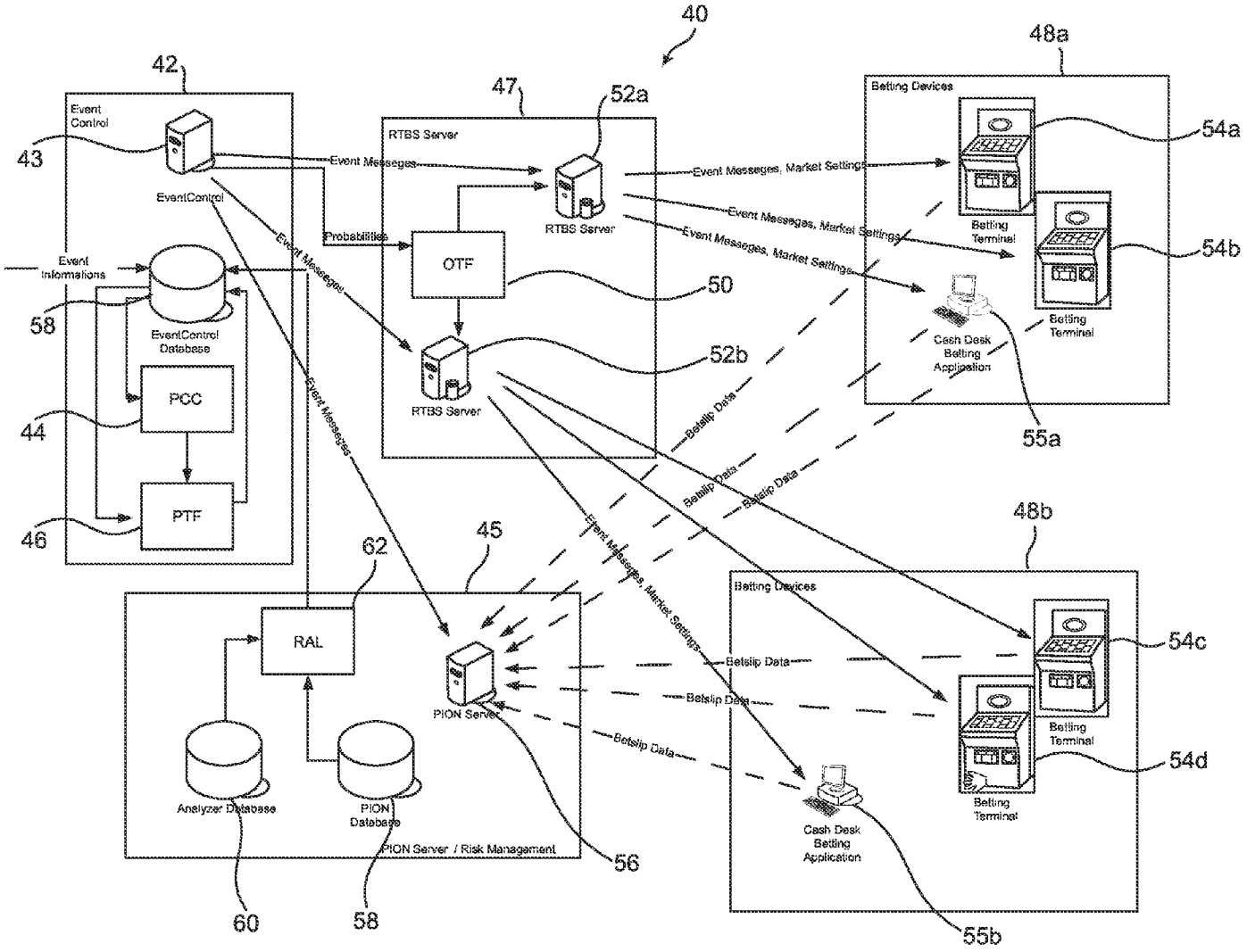
FIG. 4 is a system diagram in accordance with the present invention.

FIG. 4 shows a system diagram of a Real Time Betting System (RTBS) 40. The system 40 is designed to offer bets on certain events with a short interval. One example is bets on slot car races that take place in an interval less than five minutes. However it would be impractical for a bookmaker to calculate odds within this time confinement. In the first step it is possible to bet on the winner (win bet) or on the combination of 1st place and 2nd place (exacta bet), or both. Users can place multiple bets, each at a separate time, to take advantage of changing odds. Real time includes time frames such that delays in system performance are minimized to the extent that a typical user would not detect system time-lag between events and event information displayed via the system 40.

Components of the Real Time Betting System (RTBS)

The system 40 includes an event control-module 42, a risk management server 45, a betting server 47, and gaming terminals 48*a* and 48*b*, which are in communication via a network.

The event control module 42 is designed for sending different kinds of messages information to the system components. Such messages in one embodiment, include information about the different phases during a betting event like for instance: New, Place your bets, Finish betting, No more bets, Race, Result for the slot car races, and many more.

The event control-module 42 comprises an event control server 43, a probability calculator (PCC) 44, a probability transformer (PTF) 46, and an event control database 58, which communicate electronically. The event control database 58 receives event information from any of a number of event information sources. The event information is communicated via a network and stored on the event control database 58.

Figure 5:
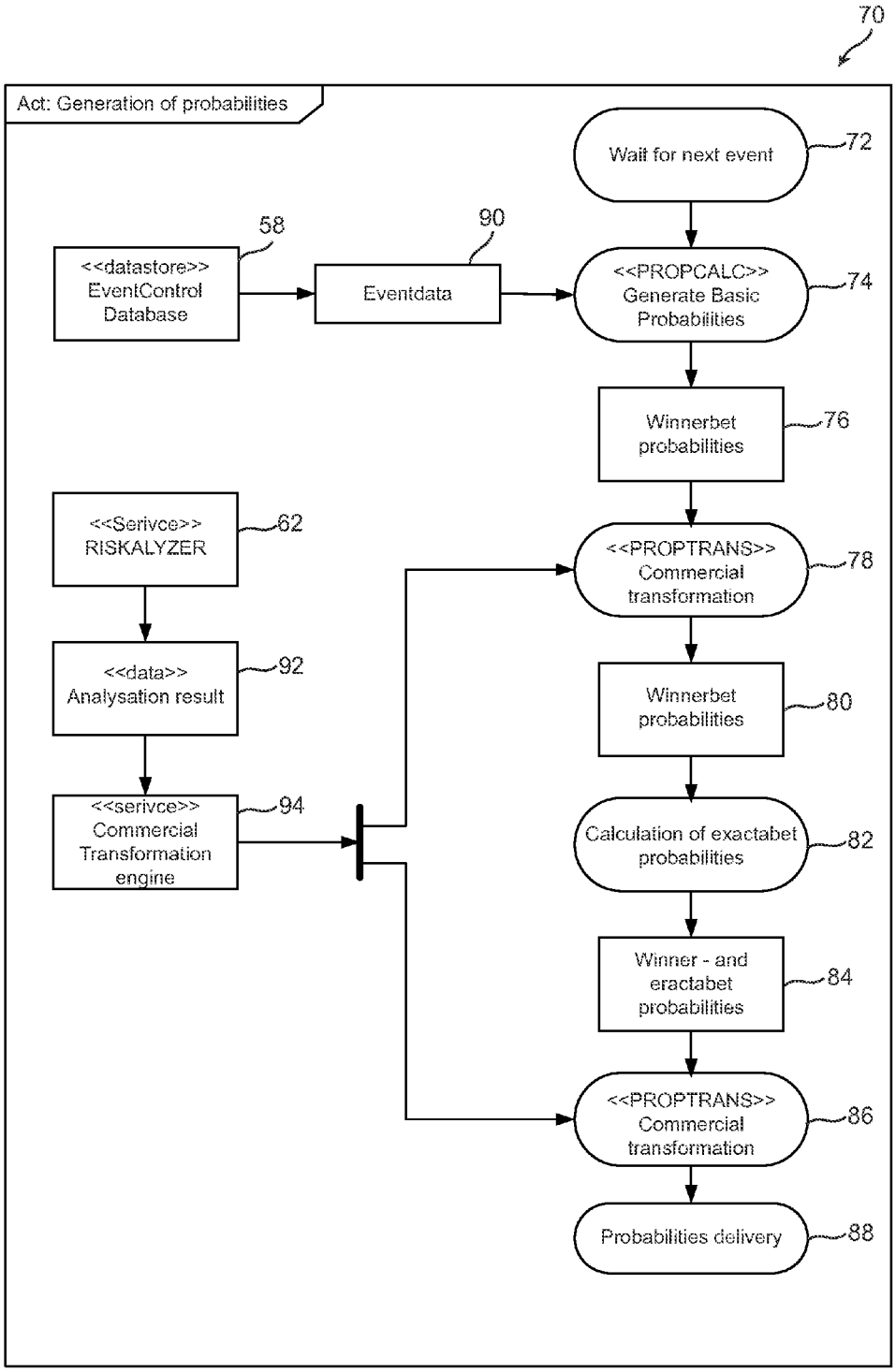
FIG. 5 is a flow chart of a method of the present invention.

The event control database 58 shares event information with the probability calculator (PCC) 44 and with the probability transformer (PTF) 46. In one embodiment of the invention the event control database 58 receives and stores a multitude of events, and the probability calculator (PCC) 46 initially compiles event data from the multitude of events to create a statistical representation of the multitude of events, which are termed basic probabilities as illustrated in step 74 of (FIG. 5). In this way natural probabilities can be generated. These natural probabilities are transformed into winner and exacta bet probabilities both at the onset and during the course of an event.

The probability transformer (PTF) 46 is adapted for initially calculating basic probabilities of each winner and each exacta combination using a set of monitored factors from the event data. The probability transformer (PTF) 46 transforms basic probabilities to business probabilities. The problem solved here is to transform the natural probabilities in a way that the system continually generates a hold value which is attractive for both the users and a bookmaker function of the system 40. The bookmaker function of the system 40 presents hold values and odds which enable bets to be placed by a user. Accordingly, the hold value fluctuates within a pre-determined range to assure ongoing financial viability of the system provider.

The RTBS Server 46 includes networked real time bet servers 52*a* and 52*b* that access an odds transfer module (OTF) 50. The odds transfer module (OTF) 50 is configured with software for transforming odds offered to a user. The odds are communicated to the user from the servers 52*a* and 52*b* via a network.

There may be several servers 52*a* and 52*b* offering different hold value, or hold value range, different jurisdictions and markets in the RTBS System where each server may have a different desired hold value or hold value range. In addition, the RTBS Server may communicate with the betting devices Terminals, Cash Desks, and Web server applications over the same messaging protocol.

There are several different kinds of gaming terminals 48*a* and 48*b* in the system 40. According to an exemplarily embodiment the terminals are numerous and spread across numerous jurisdictions and geographies. The terminals include cash desk betting applications 55*a* and 55*b* integrated into the gaming terminals 48*a* and 48*b*, respectively. The terminals 48*a* and 48*b* further include self-service betting devices 54*a*, 54*b*, 54*c*, and 54*d* that enable users to place bets directly to the system 40.

The cash desk applications 55*a* and 55*b* communicate with the system 40 via the risk management server 45, generally. The cash desk applications enable trained staff accept bets from the users and enter the bets into the system 40. The betting devices 54*a*, 54*b*, 54*c*, and 54*d* accept the bets, calculate the winnings based on the results they receive, and process payouts.

The risk management server 45 includes a PION Server 56, a PION database 58, an analyzer database 60, and a risk analyzer module 62 in operative communication. The analyzer database 60 stores data useful in calculating odds for particular events.

The PION server 56 communicates bet slip data with the various betting devices 54*a*, 54*b*, 54*c*, and 54*d*. The PION server 56 is adapted for collecting event messaging data from the event control-module 42 and bet slips and other betting information from the betting devices 54*a*, 54*b*, 54*c*, and 54*d*. The collected data may be analyzed with the risk analyzer module 62 to get a current hold situation and to compare the current hold situation with the desired hold value setting. In case the difference between these two settings is too large, a detailed analysis of the collected data may utilize the odds range and/or the factors of the PCC-module 44 and PTF-module 46. In a next step the values or parameters of the functions and calculations used inside the PCC-module 44 and/or PTF-module 46 may be adopted. A simulation-step may be performed based on or using the historical data being present in the system before the new parameter set is being activated.

How to Offer Events with a High Frequency

The system 40 (FIG. 4) provides sport events in short time intervals. For example the time duration, or interval, of an event may preferably be three minutes, more preferably the interval may be about two minutes. A sport event is characterized by a set of attendants and a result that is determined after the event is finished e.g.: car racing. Additionally to the presentation of an event a set of bets are offered to the user e.g. via the betting terminal. Due the high frequency of events it is not possible to determine the odds by a human bookmaker in a viable manner. An automated solution is required to offer events with a high frequency.

Before the start of a particular event, the attendants and depending on the determined type of event e.g.: car race, horse race, darts, and some additional conditions, are determined and broadcast to uses via betting terminals 54*a-d*. Based on this conditions and experience of previous races the user may submit a set of bets, e.g. bets on the win of a particular attendant.

The system 40, in one embodiment, depicts a slot car race where a number of cars are performing races on a racetrack. Before the start of a race a "RaceSetup" is determined. The "RaceSetup" defines a relation between Driver, Car, Track and Race, which setup is communicated to the user hence the user gets knowledge which driver starts with which car on which track. Now the user may bet on his presumed winner or on exacta events related to the particular race and/or setup. The race is carried out and shown on a video screen. After the race is finished and the result is extracted, the bets are evaluated. Wining bets may be paid out to the user immediately.

How to Assure Hold Value

One of the main problems the operator faces is the assurance of a particular hold value. The operator may be allowed to earn an expected amount of money for the service provided. In sports betting business this amount of money is defined by the hold value parameter. A high hold value means a low probability of lost but results in uncomely low odds user will not tend to place bets. In order to be economical and offer an interesting set of bets, an appropriate hold value setting would be advantageous.

One problem of an automatic bookmaker for real-time events, including live racing events, is that the desired hold value setting is not always achieved. For instance if the system provider configures a system having a hold value setting of 5% he expects that a user will contribute 5% of this stake. If this contribution of the hold value amount is not forthcoming the financial viability of providing ongoing gaming entertainment becomes uncertain.

In sports betting applications that are driven or operated by human beings achieving the hold value setting is in the scope and skills of the bookmaker.

In order to meet this demand the system 40 applies a transformation of calculated natural probabilities, thus functioning as an automatic bookmaker. This transformation maintains the hold value at a desirable range to keep users interested in continued play, and to enable system providers to maintain financially viability.

According to an aspect of the present invention the system may adapt probabilities in order to keep a fair balance for both the system provider and the user. This kind of transformation is implemented by an RAL-module. The strategy applied to carry out such a transformation may be driven by a set of parameters.

The particular value of each parameter may be based on the result of a hold value analysis. In a further aspect the particular hold value trend may be monitored and observed by a central application. The result of the observation may act as input for the parameter setting for the transformation function, or may act as input for varied transformation functions.

Probabilities Generation

FIG. 5 shows a method 70 of generating probabilities according to an exemplary embodiment of the invention. The method 70 includes the step 72 of waiting for a new event, the step 74 of generating basic probabilities, the step 76 of determining winner bet probabilities, the step 78 of performing a commercial transformation, the step 80 of determining winner bet probabilities, the step 82 of calculating exacta bet probabilities, the step 84 of determining winner and exacts bet probabilities, the step 86 of performing a commercial transformation, and the step 88 of probabilities delivery. These steps are performed in the sequence to enable real time odds-making, real time communication to a user, and real time betting based on the odds-making.

The method 70 employs the event control database 58 to deliver event data 90 used by the step 74 of generating basic probabilities. The method 70 employs the risk analyzer module 62 to deliver analysis result data 92 via the commercial transformation engine 94 to accomplish the steps 78 and 86 of performing commercial transformations.

Commercial transformation results depend on numerous factors, and in one embodiment, depends on the hold value range required by a system provider. The hold value is determinative of which transformation methodology is used to perform the commercial transformation, or which parameters are used in any particular transformation methodology.

The step 74 includes assigning probabilities. The probabilities assigned to the events are estimated based on statistical methods. Historical event data concerning previous events that have been carried out and which are stored in a database are input as source of the estimation and the output is information about estimated or natural probabilities. This step 74 is be performed by the PCC-module 44 (FIG. 4). Natural probabilities are generated based in part on the sequence of game characters, the standing of the characters which may include the distance between the characters, the amount of time remaining in the event, and on the number of bets and amounts of such bets that have already been placed. Natural probabilities, in one embodiment, depend also on the hold value required by a system provider, and jurisdictional regulations pertaining to the hold value.

In the step 76 of determining winner bet probabilities, the transformation is applied to the estimated probabilities in order to meet demands of a balanced hold value behavior. The transformation may use a particular strategy to adapt probabilities. The kind of strategy that is applied to an event is determined by the RAL-module 62. The probabilities of the exacts bets are calculated out of the probabilities of the winner bets. The probabilities of the winner and exacts bets are delivered in step 88 of delivering probabilities. The step 88 communicates probabilities to users via betting terminals 54*a-d* (FIG. 4).

The method 70 repeats for each event beginning with the step 72 of waiting for the next event.

According to an exemplary embodiment of the invention the events are races on a slot car racecourse. The historical event data stored in this case may be lap-time, finish results and/or drop outs. Based on statistical methods a mathematical probability of wins may be estimated for a particular race setup of the drivers and/or cars and/or racecourse lines.

Transformation

The commercial transformation steps 78 and 86 utilize a mathematical function to facilitate real-time odds-making. The appropriate function may be activated depending on a trend of the hold value, which trend may be analyzed by the RAL-module 62. Each jurisdiction where the system has users may have a distinct hold value applicable to that jurisdiction based on business and regulatory reasons. Accordingly the system is adapted for serving multiple jurisdictions having varied hold values. A hold value is a portion of a bet that is retained by the system operator, or owner. Preferably the hold value is a percentage of the bet.

A function utilized by the present invention is as follows:

$$\text{P_Trans} = \text{Transformation}(p) = \frac{TG}{1 + TG * \text{Factor} * \left(\frac{1}{P} - \frac{1}{TG}\right)^{Exponent}}$$

Wherein the parameters are:

P_Trans Transformed probability

P Natural probability

TG Transformation threshold

Factor Transformation multiplier

Exponent Transformation exponent

The function is applied to P when P is less than TG, otherwise P_Trans is equal to P.

Figure 6:
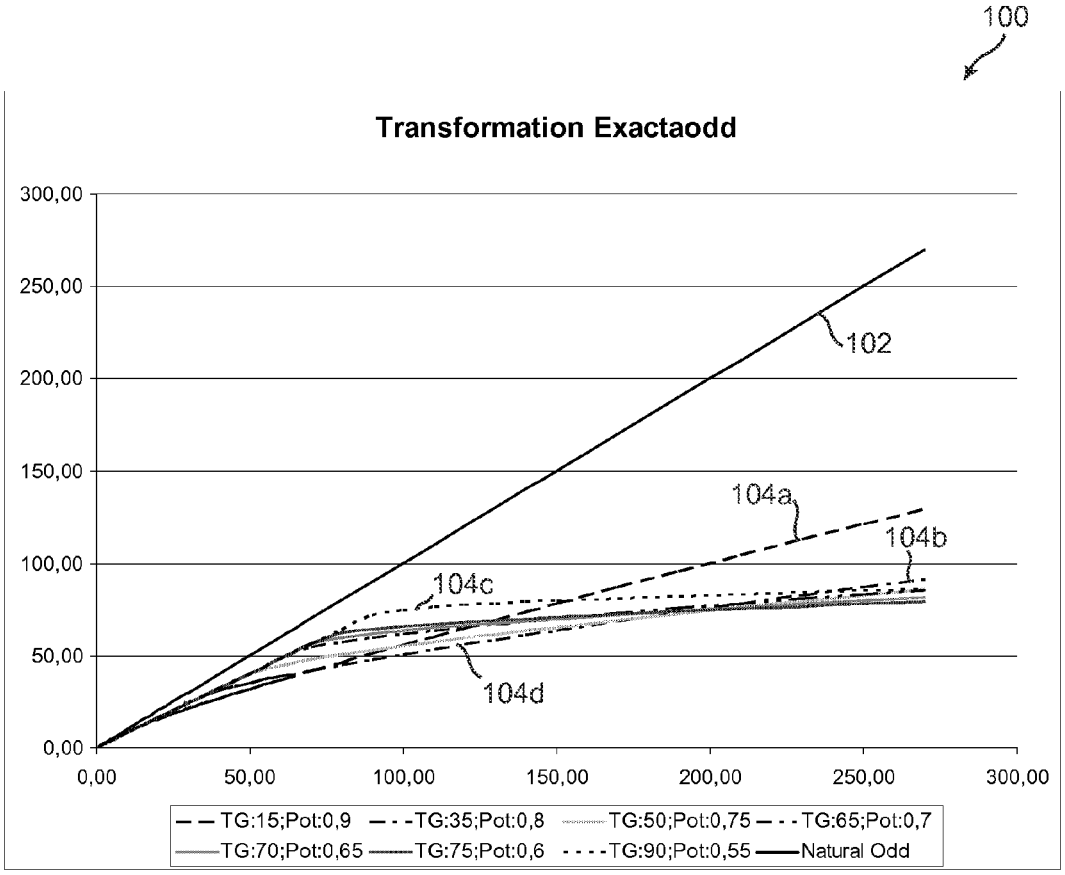
FIG. 6 is a transformation chart.

FIG. 6 shows a graphical illustration 100 of a transformation of an exacta odd. The solid line 102 represents the estimated odds at a particular time for an event. The time begins prior to the commencement of an event and continues during the course of an event. The exacta odd for a particular event, bet amount, time, is presented by the various broken lines 104*a-d* and the impact of the transformation mapping to the odds resulting from the step of commercial transformation, which yields a user odds that are published via a network to the various betting terminals 54*a-d* (FIG. 4).

Figure 7:
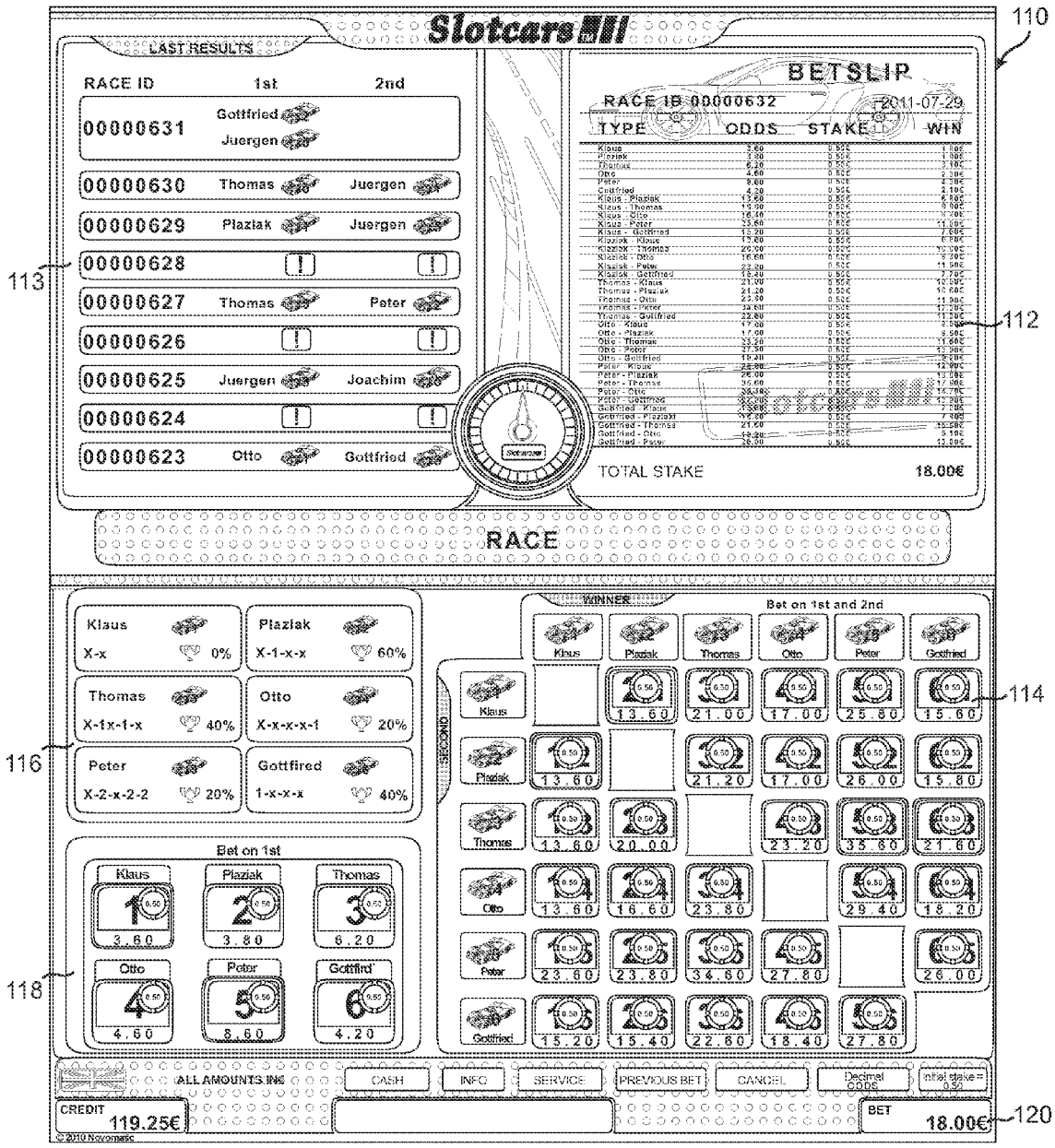
FIG. 7 is a screen shot of the gaming terminal of the present invention.

FIG. 7 shows an exemplary screen 110 displayed on a gaming terminal. The screen 110 includes a bet slip 112, a results list 113, a character list 114 for exacta betting, a character list for win bet betting 118, a list of odds for past results 118, and the bet amount 120.

The results list 113 shows which characters have won or placed $2^{nd}$ in the last ten races. The bet slip 112 shows the odds for a particular stake and the amount of payout for a win at those odds. The bet slip 112 is continually updated.

The character list for exacta betting 114 enables betting on the first and second place finishers, i.e. exacta betting, it presents a matrix showing the characters in graphical form and the odds of particular exacta bet combinations.

A user is thus enabled to choose from the display, via a touch screen interface or from a keyed interface, which bet selection to make. The bet amount can be varied. Numerous bets, placed at varying times, are also enabled.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the embodiments.

Some portions of the detailed description which follows are presented in terms of procedures, steps, logic blocks, processing, and other symbolic representations of operations on data bits that can be performed on computer memory. Each step may be performed by hardware, software, firmware, or combinations thereof.

Any examples of a database given are thus illustrative of arrangements for the storage of information. Similarly, examples of network topology are illustrative and other topologies may be used.

It will be readily apparent to one of ordinary skill in the art that the various processes described herein may be implemented by, e.g., appropriately programmed general purpose computers, special purpose computers and computing devices. Typically a processor e.g., one or more microprocessors, one or more microcontrollers, one or more digital signal processors will receive instructions e.g., from a memory or like device, and execute those instructions, thereby performing one or more processes defined by those instructions.

A "processor" means one or more microprocessors, central processing units CPUs, computing devices, microcontrollers, digital signal processors, or like devices or any combination thereof.

Thus a description of a process is likewise a description of an apparatus for performing the process. The apparatus that performs the process can include, e.g., a processor and those input devices and output devices that are appropriate to perform the process.

Further, programs that implement such methods as well as other types of data may be stored and transmitted using a variety of media e.g., computer readable media in a number of manners. In some embodiments, hard-wired circuitry or custom hardware may be used in place of, or in combination with, some or all of the software instructions that can implement the processes of various embodiments. Thus, various combinations of hardware and software may be used instead of software only.

The term "software" refers to any medium, a plurality of the same, or a combination of different media, that participate in providing data e.g., instructions, data structures which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency RF and infrared IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Thus a description of a process is likewise a description of a computer-readable medium storing a program for performing the process. The computer-readable medium can store in any appropriate format those program elements which are appropriate to perform the method.

Just as the description of various steps in a process does not indicate that all the described steps are required, embodiments of an apparatus include a computer/computing device operable to perform some but not necessarily all of the described process.

Likewise, just as the description of various steps in a process does not indicate that all the described steps are required, embodiments of a computer-readable medium storing a program or data structure include a computer-readable medium storing a program that, when executed, can cause a processor to perform some but not necessarily all of the described process.

Where databases are described, it will be understood by one of ordinary skill in the art that alternative database structures to those described may be readily employed, and ii other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats including relational databases, object-based models and/or distributed databases could be used to store and manipulate the data types described herein. Likewise, object methods or behaviors of a database can be used to implement various processes, such as the described herein. In addition, the databases may, in a known manner, be stored locally or remotely from a device which accesses data in such a database.

Various embodiments can be configured to work in a network environment including a computer that is in communication e.g., via a communications network with one or more devices. The computer may communicate with the devices directly or indirectly, via any wired or wireless medium e.g. the Internet, LAN, WAN or Ethernet, Token Ring, a telephone line, a cable line, a radio channel, an optical communications line, commercial on-line service providers, bulletin board systems, a satellite communications link, a combination of any of the above. Each of the devices may themselves comprise computers or other computing devices, such as those based on the Intel® Pentium® or Centrino® processor, that are adapted to communicate with the computer. Any number and type of devices may be in communication with the computer.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a process is described, in an embodiment the process may operate without any user intervention. In another embodiment, the process includes some human intervention e.g., a step is performed by or with the assistance of a human.

What is claimed is:

1. A system for enabling betting during the course of an event, comprising:

a physical arena having a track and devices that move in a pattern around the track;

a cinematic display corresponding to the physical arena for displaying events and for displaying odds during the course of a particular event;

a computer in operative communication with the physical arena and the cinematic display for generating basic outcome probabilities of event outcomes for the set of events;

the computer initially determines a first win bet probability for a particular event, transforms the first win bet probability based on a transformation function to enable initial betting on the particular event;

during the course of the particular event, the computer determines a second win bet probability and transforms the second win bet probability based on the transformation function, and delivers the transformed second win bet probability to a user to enable the user to execute a bet in real time during the course of the event.

2. The system according to claim 1, wherein the track includes slots and the devices that move in a pattern are slot-enabled.

3. The system according to claim 2, wherein the devices are slot cars.

4. The system according to claim 2, wherein the devices are horse-models.

5. The system according to claim 1, wherein the computer is in communication with a risk management server and an event control server, the event control server receives event data and assigns natural probability values to the event data, the risk management server establishes a hold percentage.

6. The system according to claim 5, wherein the natural probabilities change in real time during the course of an event and the transformation means transforms the natural probabilities in real time during the course of the event.

7. The system according to claim 6, wherein the system provides a betting window of time, which expires during the course of the event.

8. The system according to claim 7, wherein the events have a duration of less than three minutes.

9. A system for enabling real-time betting on events, comprising:

a physical arena having a track and devices that move in a pattern around the track;

an event control module having an event control database, the event control database stores data representing numerous events;

a risk management server in communication with the event control module, the risk management server and the event control module cooperate for establishing natural probabilities for event outcomes and transforming natural probabilities to winner bet values based in real time during the course of an event;

a betting server in communication the event control module and with the risk management server for establishing hold values and communicating the winner bet values and event information; and gaining terminals in communication with the physical arena and the betting server for communicating winner bet odds and event information to a user and for receiving bets from the user, the gaming terminals each include a physical arena having a track and devices that move in a pattern around the track;

a cinematic display corresponding to the physical arena for displaying events and for displaying odds during the course of a particular event;

whereas the risk management server transforms the natural probabilities in real time during the course of an event to enable real-time communication of the winner bet values to users.

10. The system according to claim 9, wherein the gaining terminals are kiosks located in more than one jurisdiction and the betting server establishes a hold value for each jurisdiction.

11. The system according to claim 10, wherein the event control module initiates various messages communicated via the system to the gaining terminals including betting window duration, odds, hold values and event status information.

12. The system according to claim 11, wherein the event control module includes a probability calculator (PCC) that compiles event data from the multitude of events to create a statistical representation of the multitude of events.

13. The system according to claim 12, wherein the event control module identifies and monitors a predetermined set of factors in the event data and includes a probability transformer (PTF) adapted for calculating basic probabilities of event outcomes including winner bet and exacta combinations using the set of monitored factors.

14. A method of betting on racing events, comprising:

providing a physical arena having a track and devices that move in a pattern around the track;

providing a cinematic display corresponding to the physical arena for displaying events having a duration of less than three minutes and for displaying odds during the course of a particular event;

generating basic outcome probabilities of event outcomes for the set of events;

determining a win bet probability for a particular event;

transforming the win bet probability based on a transformation function to enable betting in real time;

during the course of the particular event, determining a win bet probability and transforming the win bet probability based on the transformation function; and delivering the win bet probability to a user to enable the user to execute a bet in real time.

15. The method according to claim 14 further comprising: receiving a win bet.

16. The method according to claim 14 further comprising: determining an exacta bet probability and receiving an exacta bet.

17. The method according to claim 14 further comprising: determining a hold value and utilizing the hold value to enable transformation of the win bet probability.

18. The method according to claim 14 further comprising: determining a hold value and utilizing the hold value to achieve transformation function results.

19. The method according to claim 18, wherein the racing event includes racing event characters represented by the devices, the characters having a sequence and the step of determining win bet probability is performed based on a change in the sequence of racing event characters.

20. The method according to claim 18, wherein the characters are automobiles.

* * * * *